US006899589B1

(12) United States Patent
Lund et al.

(10) Patent No.: US 6,899,589 B1
(45) Date of Patent: May 31, 2005

(54) BOUNCING AND MOVING TOY FIGURE

(76) Inventors: Bruce D. Lund, 2557 Pensacola Ave., Chicago, IL (US) 60618; Sunil Moothedath, 4104 N. California #2, Chicago, IL (US) 60618

( * ) Notice: Subject to any disclaimer, the term of this patent is extended or adjusted under 35 U.S.C. 154(b) by 0 days.

(21) Appl. No.: 10/804,032

(22) Filed: Mar. 19, 2004

(51) Int. Cl.[7] ..... A63H 13/00

(52) U.S. Cl. ..... 446/351; 446/356; 446/379; 446/390

(58) Field of Search ..... 446/297, 298, 446/303, 317, 330, 351, 352, 353, 356, 376, 377, 383, 390, 379–381, 308, 311, 312

(56) References Cited

U.S. PATENT DOCUMENTS 1,152,639 A * 9/1915 Isaacs ..... 446/311
2,896,948 A * 7/1959 Brodrib ..... 472/99
3,452,473 A * 7/1969 Convertine ..... 446/353
3,630,520 A * 12/1971 Cooper ..... 273/459
4,878,875 A * 11/1989 Pin-Hung et al. ..... 446/356
5,626,505 A * 5/1997 Cheng ..... 446/278
5,820,441 A * 10/1998 Pracas ..... 446/354
5,941,599 A * 8/1999 Roberts ..... 297/115

* cited by examiner

*Primary Examiner*—Bena B. Miller

(57) ABSTRACT

A toy animal mounted on 4 spring legs to permit movement of the animal in response to the rotation of an eccentrically mounted weight. This weight is mounted in the front body portion about a shaft disposed transverse to the body portion. The shaft is driven by a reversible motor, the speed and direction of which is controlled by a program controller.

11 Claims, 2 Drawing Sheets

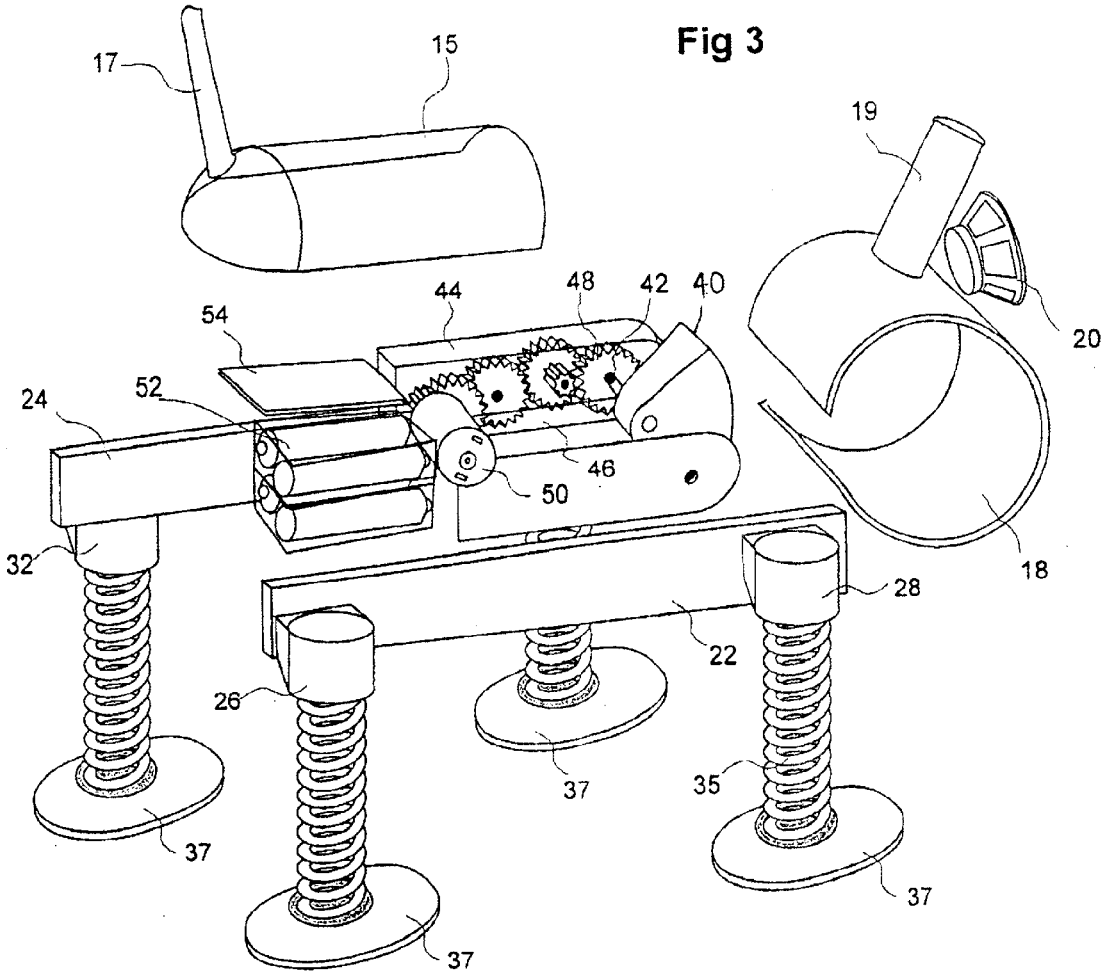
Fig 3
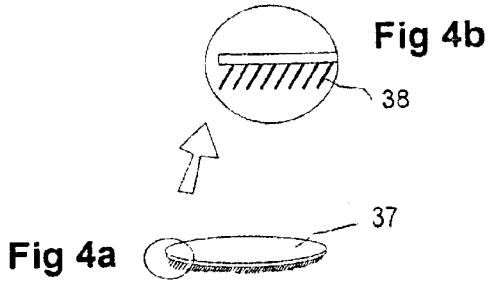
Fig 4b
Fig 4a

BOUNCING AND MOVING TOY FIGURE

BACKGROUND OF THE INVENTION

Toy animals are among the most popular of toys for young children. These types of toys are designed to move in any number of ways, such as walking, crawling, jumping, dancing, etc. There is a continuing need for toy animals that perform in different ways to serve as a source of amusement for children.

SUMMARY OF THE INVENTION

There is herein described an illustrated a toy animal having four (4) legs that is capable of bouncing up and down, moving forward, backward, sideways in a haphazard direction or jump in different rhythmic patterns. While the animal illustrated is a tiger, it is but one example of an animal to which the invention can be applied. This is accomplished by providing the animal with four (4) spring legs having foot pads. The movement of the legs is created by the rotating of a massive weight in the forward body portion of the animal, which weight is eccentrically mounted on a power driven shaft. Rotation of the eccentrically mounted weight is accomplished by a reversible drive motor through a set of gears, which movement will result in different actions of the legs and animal movement as determined by the direction of rotation and the speed at which the weight is rotated. The direction and speed of the motor is regulated by an electronic controller that receives power from batteries controlled by a switch.

Essentially, the mass of the weight and the eccentric distribution of the weight imparts a vibration to the entire body of the animal and the springs in the legs translate this vibration to a jumping movement. In the case of clockwise or counter-clockwise rotation of the eccentric weight at a low speed on the order of 50 rpm (when looking at the right side as shown in the drawings), the spring legs of the animal having pads on the legs will shake but will essentially bring about no lifting of the legs. At slow rotational speeds there is not enough force action on the back leg springs. With directional pads on the legs the animal will move in a forward direction at small increments. This is created by the bottom of the pads formed with bristles on the bottom angled in a rearwardly direction.

When the gear driven weight is rotated counter-clockwise at a medium speed on the order of 150–200 rpm, the action on the rear spring legs will result in the animal incrementally moving forward in a relatively straight line a greater distance than that which occurred at the relatively slow rotating speed of the eccentric weight. This speed of the eccentric weight results in a build up of the harmonic motion of the springs in the rear legs.

In the case of the eccentric weight moving in a clockwise direction at a medium speed, the front spring legs are periodically compressed relative to the rear spring legs resulting in a rearing or upward movement of the front portion of the animal relative to the rear portion.

When the eccentric weight is rotated at a high speed on the order of 300–500 rpm in the counter-clockwise direction, the animal moves incrementally forward at a longer distance than when being operated at a medium speed. The animal also moves in less of a straight line than when moved at a medium speed.

Movement of the eccentric weight in a clockwise direction at a high speed results in a haphazard movement of the animal. The rapid compression and release of the front spring legs result in an unpredictable bouncing of the animal in that it will randomly move forward, backward or sideways.

A speaker is also provided and is programmed by the electronic controller so that the sounds coming therefrom relates to the speed at which the motor is operating such as I can bounce faster or I can bounce fasterer.

To have a better understanding of the Invention, reference is made to the following detailed description of the invention, from the claims and from the accompanying drawings in which:

FIG. 3 is an exploded perspective view of the tiger with the outer covering removed;

FIG. 4A is a detailed view of one form of bristle pads that can be connected to provide support for the leg springs; and FIG. 4B is an enlarged view of a section of the bristle pad shown in FIG. 4A illustrating the thistle orientation.

DETAILED DESCRIPTION OF THE DRAWINGS

Figure 1:
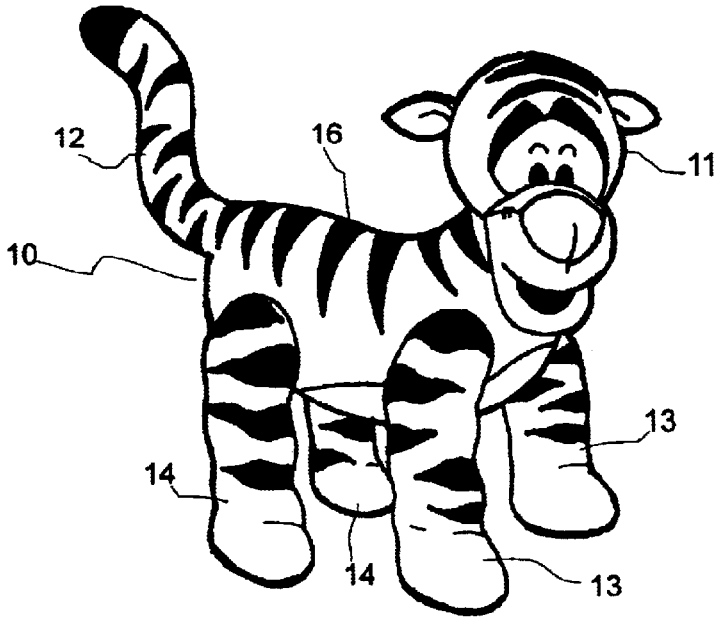
FIG. 1 is a perspective view of a tiger incorporating the present invention.

Referring first to FIG. 1, there is illustrated a tiger 10 having a head portion 11, a tail 12, front legs 13, rear legs 14 and body portion 16.

Figure 2:
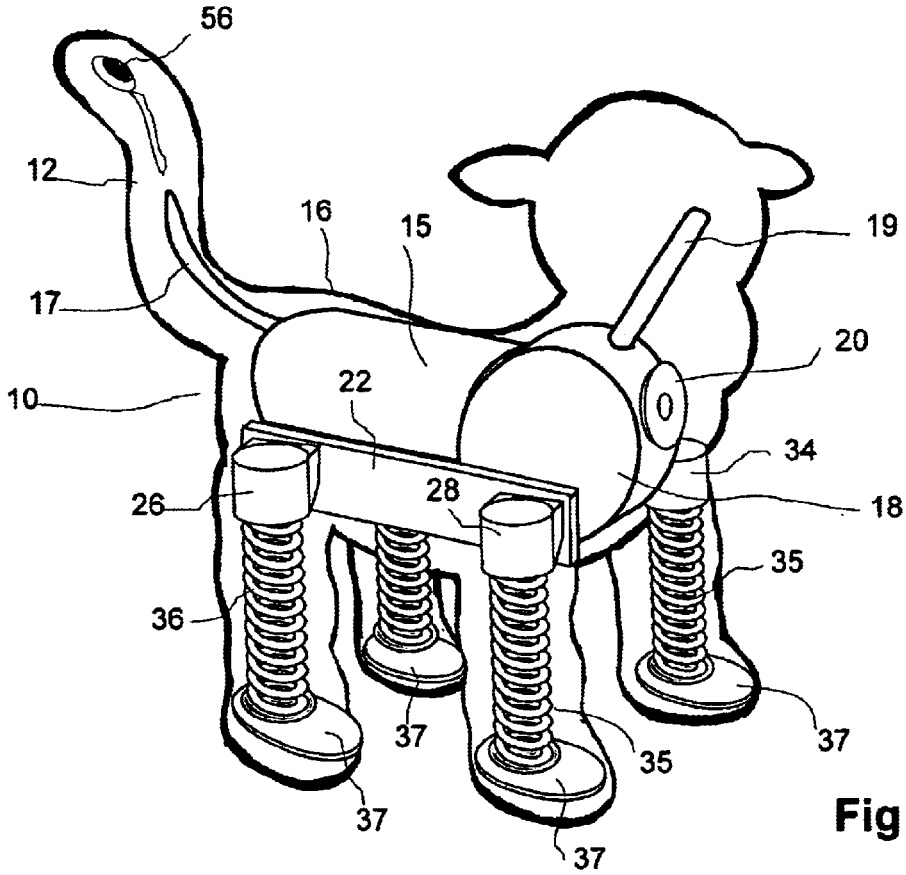
FIG. 2 is a perspective view of the tiger of FIG. 1 shown with the outer portion partially removed.

In FIG. 2 the tiger is shown in outline form with the interior components exposed. There is included in FIG. 2 the enclosure 15 in the body portion 16 of the tiger. To support the tail 12, a rod 17 connected to the enclosure 15 is provided. Located at the front end of the enclosure 15 is a generally cylindrical guard and enclosure 18 for the eccentrically mounted rotating weight, to be described in detail hereinafter. Secured to the front of the guard 18 is a rod 19 for supporting the head 11 and a speaker 20 for sounds determined by an electronic circuit board programmed to relate to the movement of the tiger.

The essence of the invention relates to the movement of the tiger in response to the action of an eccentric weight located in the front body portion of the tiger that is rotated at various speeds in accordance with a programmed electronic circuit board that is controlled by a switch means.

The internal structure of the tiger consists of a frame assembly made up of a right side plate 22 and a left side plate 24. Connected to the rear of plate 22 is a cap 26 for receiving the upper end of rear leg spring 36. Secured to the front end of plate 22 is cap 28 that receives the upper end of front leg spring 35.

The left side plate 24 includes caps 32,34 for receiving the upper ends of rear and front leg springs 36,35, respectively. The bottoms of the leg springs have thistle pads 37 connected thereto that are moved by the action of the spring to which they are connected. The thistles 38 are directed in a rearward direction (see FIGS. 4A and 4B) to provide for forward movement of the spring legs and toy animal 10. The pads can be flat on the bottom and not have directional thistles.

Movements of the tiger are brought about by the action of a rotated eccentric weight located in the front central area of the tiger body 16. The weight 40 is mounted on a shaft 42 that is driven by a motor driven gear assembly 46 located in a gearbox 44. The end gear 48 of the gear assembly 46 rotates the shaft 42 in accordance with the direction of rotation of the reversible motor 50. Power for the motor 50 is provided by the batteries 52. Located above the batteries 52 is an electronic circuit board that controls the direction and speed of the motor 50 as well as the sounds emanating from the speaker 20. The gearbox, motor, gear assembly, batteries and electronic circuit board are located within the enclosure 15.

The responsiveness and action of the toy tiger 10 is a result of the direction of movement and speed of movement of the eccentric weight 40. Those actions as well as the sounds emanating from the speaker, which sounds are synchronized to correspond to the different routines of the animal, are regulated by the electronic circuit board 54. The motor 50 is reversible and designed to be operated at low, medium or high speeds and to rotate the weight in either a clockwise or counter-clockwise direction. The movement of the weight imparts a vibration to the entire body of the toy tiger and the springs in the legs translate this vibration to a jumping movement.

Method of Operation

By changing the direction of rotation of the motor and by controlling the speed and timing thereof it is possible to get several kinds of jumping of the toy animal. A switch 56 is located in the tail for adjusting and controlling the operation of the toy animal 10 as determined by the electronic circuit board 54. Specifically, when the motor 50 is operating at a slow speed on the order of 50 rpm and the weight is moving in either a clockwise or counterclockwise direction the tiger essentially just bounces in place when there is no directional padding in place, i.e., the fibers on the bottom of the pad are not directional in nature. If there is directional padding in place as shown in FIG. 4B, the tiger will move forward at relatively small increments in a generally straight line.

A medium motor speed on the order of 150–200 rpm will result in different movements of the tiger depending on whether the motor is rotating the eccentric weight in a counter-clockwise or clockwise direction. When the motor is rotating the weight in a counter-clockwise direction at a medium speed there is an increased force on the back legs and a harmonic motion sets up therein to move the tiger forward at a faster rate and greater incremental distance in more or less of a straight line, than when the motor is operating at a low speed. This action is not significantly affected by the leg pads whether or not they are directional in nature.

When the weight is being moved in a clockwise direction the front spring legs compress and when released the tiger raises up on its back legs with a resulting rearing action of the tiger.

When the motor 50 is driven at a high speed on the order of 300 to 500 rpm the action of the tiger will again depend on whether the movement is in a clockwise or counter-clockwise direction but will not be significantly affected by whether or not the pad fibers are directional.

During the counter-clockwise movement of the eccentric weight at a high speed there will be a larger incremental movement of the tiger in a generally straight line than when operating at a medium speed. The rear legs rebound with a larger force therefrom.

However, when the eccentric weight is rotated at a high speed in a clockwise direction the front legs rapidly compress more due to larger forces imposed thereon and this results in a haphazard movement of the tiger, which may be forward, backward or sideways.

It is intended by the following claims to cover all features and embodiments that fall within the true spirit and scope of the invention.

What is claimed is:

1. A toy animal having a body portion, head and tail, and four spring legs for supporting said animal, a shaft located transverse to said body portion and disposed adjacent the head and supporting an eccentrically mounted weight, a power operated switch controlled motor and drive assembly for said shaft, said motor is reversible to drive the eccentric weight in both a clockwise and counter-clockwise direction to set up different motions of the animal depending on the speed and direction in which the counter weight is moved whereby upon operation of said motor and drive assembly the animal vibrates to provide a jumping action of said legs and attendant movement of said animal.

2. A toy animal as set forth in claim 1 including an electronic circuit controller which when activated programs the speed and direction of the motor to effect preprogrammed actions of the toy animal.

3. A toy animal as set forth in claim 2 which includes a speaker, the output of which is regulated by the electronic circuit controller to coordinate the speaker sounds with the programmed movement of the animal.

4. A toy animal as set forth in claim 3 in which the speaker, motor and controller are powered by batteries and the switch for controlling same is located in the tail of the animal.

5. A toy animal as set forth in claim 3 in which the drive assembly for the eccentrically mounted weight is a gear drive that is enclosed within a gear box, the weight is enclosed by a guard and the speaker is secured to said guard.

6. A toy animal having a body portion, head and tail, and four spring legs having upper and lower ends for supporting said animal, a shaft located transverse to said body portion and disposed adjacent the head and supporting an eccentrically mounted weight, a power operated switch controlled motor and drive assembly for said shaft, a frame assembly that supports the eccentrically mounted weight and power operated motor and drive assembly and the spring legs are interconnected to said frame assembly, which frame assembly includes cap members for receiving the upper ends of the spring legs and there are provided pads connected to the lower ends of the spring legs, whereby the movement of the eccentric weight vibrates the frame assembly to provide a jumping action of the legs and attendant movement of the animal.

7. A toy animal as set forth in claim 6 wherein movement of the eccentric weight at a relatively low speed in both the clockwise and counter-clockwise direction causes the animal to essentially jump in place or move forward in small increments.

8. A toy animal as set forth in claim 6 wherein movement of the eccentric weight in a counter-clockwise direction at a medium speed causes the animal to move forward in a generally straight line in medium size increments.

9. A toy animal as set forth in claim 6 wherein movement of the eccentric weight in a clockwise direction at a medium speed causes the animal to bounce on its front legs and essentially rear-up in place.

10. A toy animal as set forth in claim 6 wherein movement of the eccentric weight in a counter-clockwise direction at a relatively high speed will cause the animal to move forward in relatively large increments in a generally straight line.

11. A toy animal as set forth in claim 6 wherein movement of the eccentric weight in a clockwise direction at a relatively high speed causes the animal to move in a random fashion that can be forward, backward or side-ways.

* * * * *